US011335169B1

(12) United States Patent
Meadows et al.

(10) Patent No.: US 11,335,169 B1
(45) Date of Patent: May 17, 2022

(54) SECURE AND AUTHENTIC ONLINE PLAYER AND LIVE DEALER VIDEO STREAMED VIRTUAL POKER SYSTEM AND PROCESS

(71) Applicants: Dustin Lee Meadows, Farmville, VA (US); Richard Dane Coates, Franklin, TN (US)

(72) Inventors: Dustin Lee Meadows, Farmville, VA (US); Richard Dane Coates, Franklin, TN (US)

( * ) Notice: Subject to any disclaimer, the term of this patent is extended or adjusted under 35 U.S.C. 154(b) by 0 days.

(21) Appl. No.: 17/563,896

(22) Filed: Dec. 28, 2021

(51) Int. Cl.
*G07F 17/32* (2006.01)

(52) U.S. Cl.
CPC ..... *G07F 17/3293* (2013.01); *G07F 17/322* (2013.01); *G07F 17/323* (2013.01)

(58) Field of Classification Search
USPC ..... 463/11, 12, 13
See application file for complete search history.

(56) References Cited

U.S. PATENT DOCUMENTS 8,727,892 B1 * 5/2014 Chun ..... G07F 17/3225 463/40
2007/0001398 A1 * 1/2007 Walker ..... G07F 17/3244 273/292
2011/0079959 A1 * 4/2011 Hartley ..... G07F 17/3223 463/22
2015/0325087 A1 * 11/2015 Pagano ..... G07F 17/32 463/12
2015/0339884 A1 * 11/2015 Chun ..... G07F 17/3244 463/25
2015/0343300 A1 * 12/2015 Aboumrad, Sr. ... A63F 3/00157 273/292
2019/0096191 A1 * 3/2019 Stuehling ..... G07F 17/3293

* cited by examiner

*Primary Examiner* — Pierre E Elisca
(74) *Attorney, Agent, or Firm* — Plager Schack LLP; Mark H. Plager; Stephen Hallberg

(57) ABSTRACT

A secure and authentic online player and live dealer video streamed virtual poker system and process is disclosed. The virtual poker platform is implemented as a software-based system with a cloud-based software application service and website that constructs a virtual platform that links professional poker dealers with real players to increase accessibility and to promote unmatched integrity within the online poker community. This allows players the best live feel while being able to play poker remotely and provides all users peace of mind of knowing that their cards are authentic and randomized. Furthermore, the virtual poker platform has a game flow that is a very similar representation to live poker, which provides a similar user experience to real life play, while ensuring that players are playing against other real people and eliminating concerns about programmed computer players and superusers.

15 Claims, 7 Drawing Sheets

SECURE AND AUTHENTIC ONLINE PLAYER AND LIVE DEALER VIDEO STREAMED VIRTUAL POKER SYSTEM AND PROCESS

BACKGROUND

Embodiments of the invention described in this specification relate generally to gaming systems, and more particularly, to a secure and authentic online player and live dealer video streamed virtual poker system that provides a secure blockchain and live video stream-based virtual poker platform configured to promote integrity of play and authenticity of dealers and players and a secure and authentic online player and live dealer video streamed virtual poker process for promoting integrity of play in a virtual poker environment by way of blockchain and live streaming of a real live dealer at a real live poker table dealing real live cards to virtual players who are virtually positioned around the real live poker table.

The online poker community has lost a large amount of credibility over the years due to corruption, collusion, and other nefarious actions. It's to the point where poker players simply do not trust online forums or applications and will only play live (in-person) poker.

Historically, online poker companies have connected players via a simplistic virtual table with avatars representing each user. The problem with online poker is that poker applications are typically dependent on number generators and algorithms. This causes a high variance of hands. The high variance causes distrust among the online poker community and is typically an advantage to pro players while leaving average gamers at at a disadvantage. This results in distrust in online poker sites. Furthermore, the existence of programmed computer players and prevalence of super users has also resulted in lost trust among a substantially large portion of the poker playing community.

Therefore, what is needed is a way to improve the virtual gaming client experience by providing a very similar experience to in-person play and increasing security from players who plan to exploit others or cheat, such as by eliminating super users and programmed bots to achieve true randomness with a live dealer which prevents anyone from programming into the application, and thereby preventing the egregious rates of winning by such super users and programmed computer bots or players.

BRIEF DESCRIPTION

A novel secure and authentic online player and live dealer video streamed virtual poker system that provides a secure blockchain and live video stream-based virtual poker platform configured to promote integrity of play and authenticity of dealers and players and a novel secure and authentic online player and live dealer video streamed virtual poker process for promoting integrity of play in a virtual poker environment by way of blockchain and live streaming of a real live dealer at a real live poker table dealing real live cards to virtual players who are virtually positioned around the real live poker table are disclosed.

In some embodiments, the secure and authentic online player and live dealer video streamed virtual poker system connects real people online via a secure blockchain and live video stream-based virtual poker platform with a real, live action dealer to ensure integrity and increase security. In some embodiments, the secure and authentic online player and live dealer video streamed virtual poker system provides players the best live feel while being able to play poker remotely via online connection to the secure blockchain and live video stream-based virtual poker platform. In some embodiments, the secure and authentic online player and live dealer video streamed virtual poker system provides certainty of authenticity by live stream video of real, live dealers at real, live tables dealing real, live cards to virtual players, and by blockchain utilization, thereby eliminating concerns about programmed computer players (hereinafter also referred to as "bots") and superusers.

In some embodiments, the secure and authentic online player and live dealer video streamed virtual poker system replaces algorithms and number generators found in typically online poker apps with a live human dealer at a live physical poker table and live cards (live card hands) dealt by the live human dealer, thereby lowering hand variance while effectuating true randomness of live dealt hands for online players. Furthermore, with a live human dealer, no one can program into the application and win at egregious rates since superusers and bots are eliminated. In this way, the secure and authentic online player and live dealer video streamed virtual poker system allows poker players of all skill levels to play from the comfort of their home, while being dealt hands from an actual dealer.

In some embodiments, the secure and authentic online player and live dealer video streamed virtual poker process for promoting integrity of play in a virtual poker environment by way of blockchain and live streaming of a real live dealer at a real live poker table dealing real live cards to virtual players who are virtually positioned around the real live poker table comprises a plurality of steps. In some embodiments, the plurality of steps of the secure and authentic online player and live dealer video streamed virtual poker process comprises (i) a step for a player to log into the secure blockchain and live video stream-based virtual poker platform, (ii) a step for player registration as needed, (iii) a step for the player to select a table at which to play in a poker event, (iv) a step during which a live dealer distributes (or "deals") live cards at a live poker table, (v) a step for converting the live cards distributed to each virtual player to virtual cards of a virtual card hand dealt to each virtual player by way of integrated technology, (vi) a step for encrypting and writing data for the virtual cards in each virtual card hand to a blockchain, and (vii) a step during which virtual player interactions during the virtual poker event (including card play and bet actions selected by each virtual player) are encrypted and written to the blockchain. In some embodiments, steps (iv) through (vii) are repeated by the secure and authentic online player and live dealer video streamed virtual poker process for each virtual card hand played.

In some embodiments, the step for player registration comprises a step during which the player makes a profile and sets up an account. After the player makes the profile and sets up the account, the secure and authentic online player and live dealer video streamed virtual poker process of some embodiments verifies the account via the blockchain and other platform security measures configured to distinguish real live players from bots and superusers. After the account is verified, the secure and authentic online player and live dealer video streamed virtual poker process continues with further steps comprising (i) encrypting and storing transactions for deposits, wager amounts, payouts, and other monetary adjustments in the blockchain, (ii) recording all transaction history, by way of a server, in the blockchain, (iii) dispersing the transaction history to a network of computers associated with at least the virtual players, and (iv) persisting (storing forever) all transaction history in a poker event and player stats database.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having thus described the invention in general terms, reference is now made to the accompanying drawings, which are not necessarily drawn to scale, and which show different views of different example embodiments.

Figure 1:
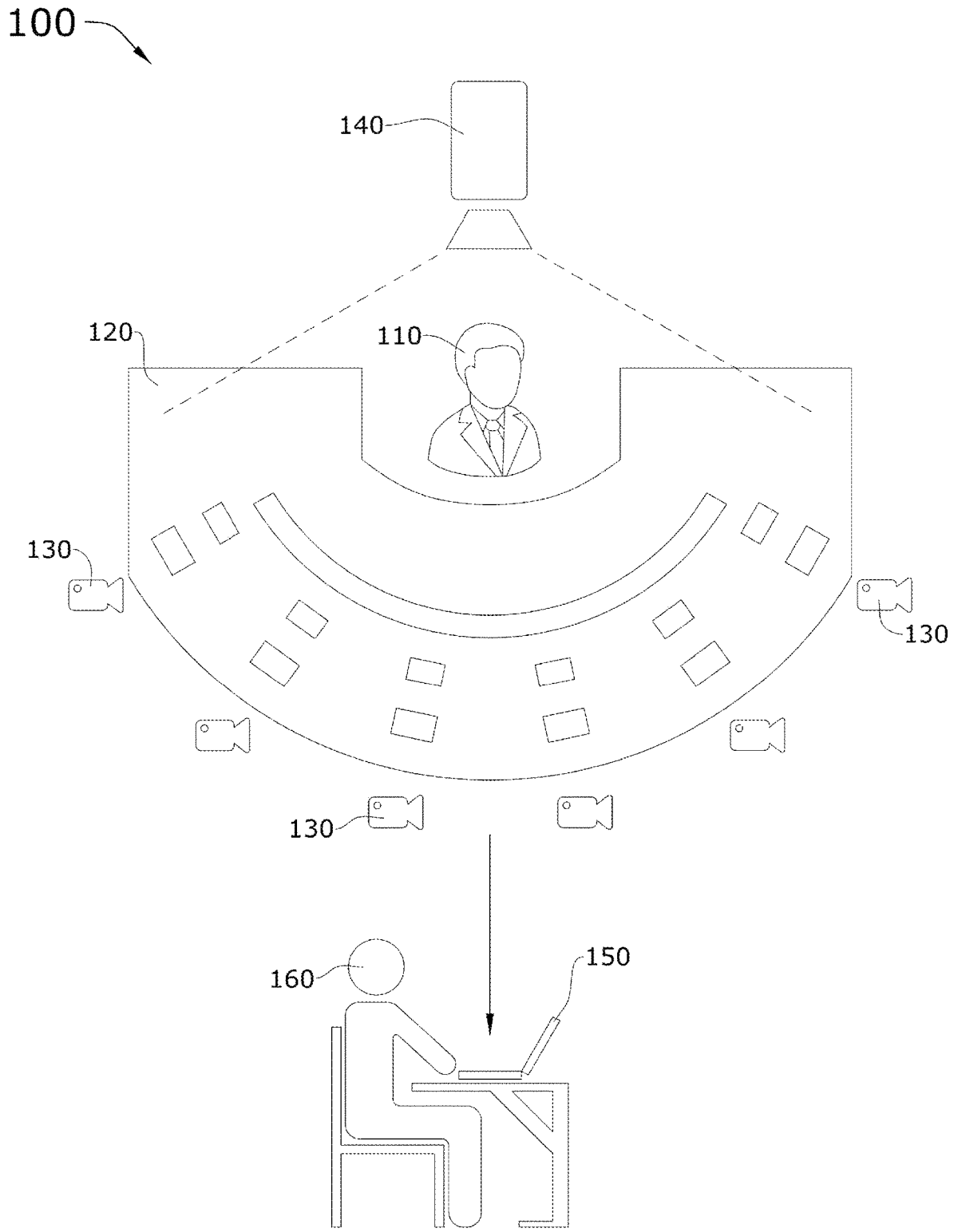

FIG. 1 conceptually illustrates a schematic diagram of a virtual poker system that promotes integrity of play and authenticity of dealers and players in some embodiments.

Figure 2:
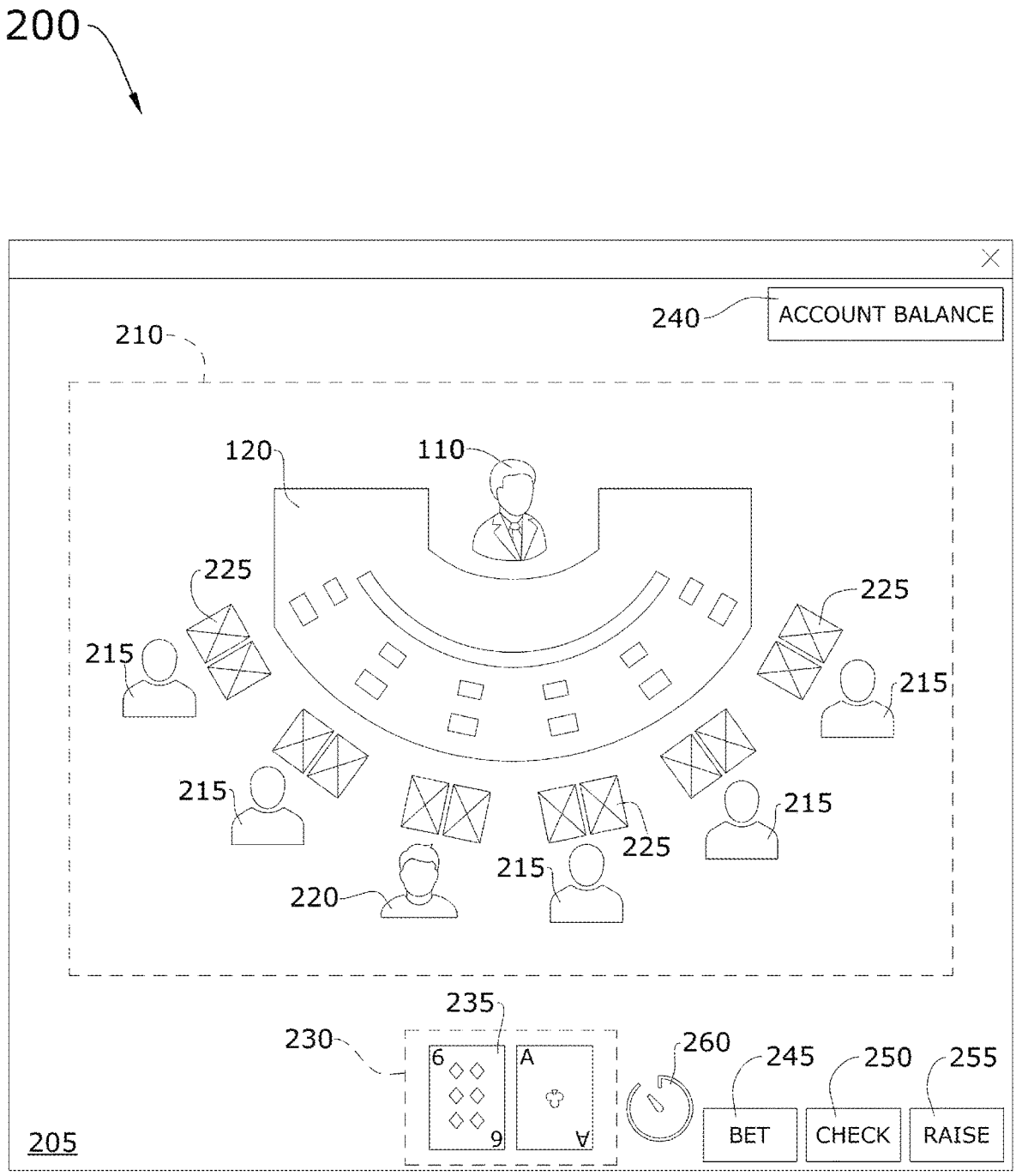

FIG. 2 conceptually illustrates a user interface (UI) of a dedicated virtual poker blockchain client software application that is used to view a live stream video of a live poker dealer at a real poker table and interact with UI tools for a poker event in some embodiments.

Figure 3:
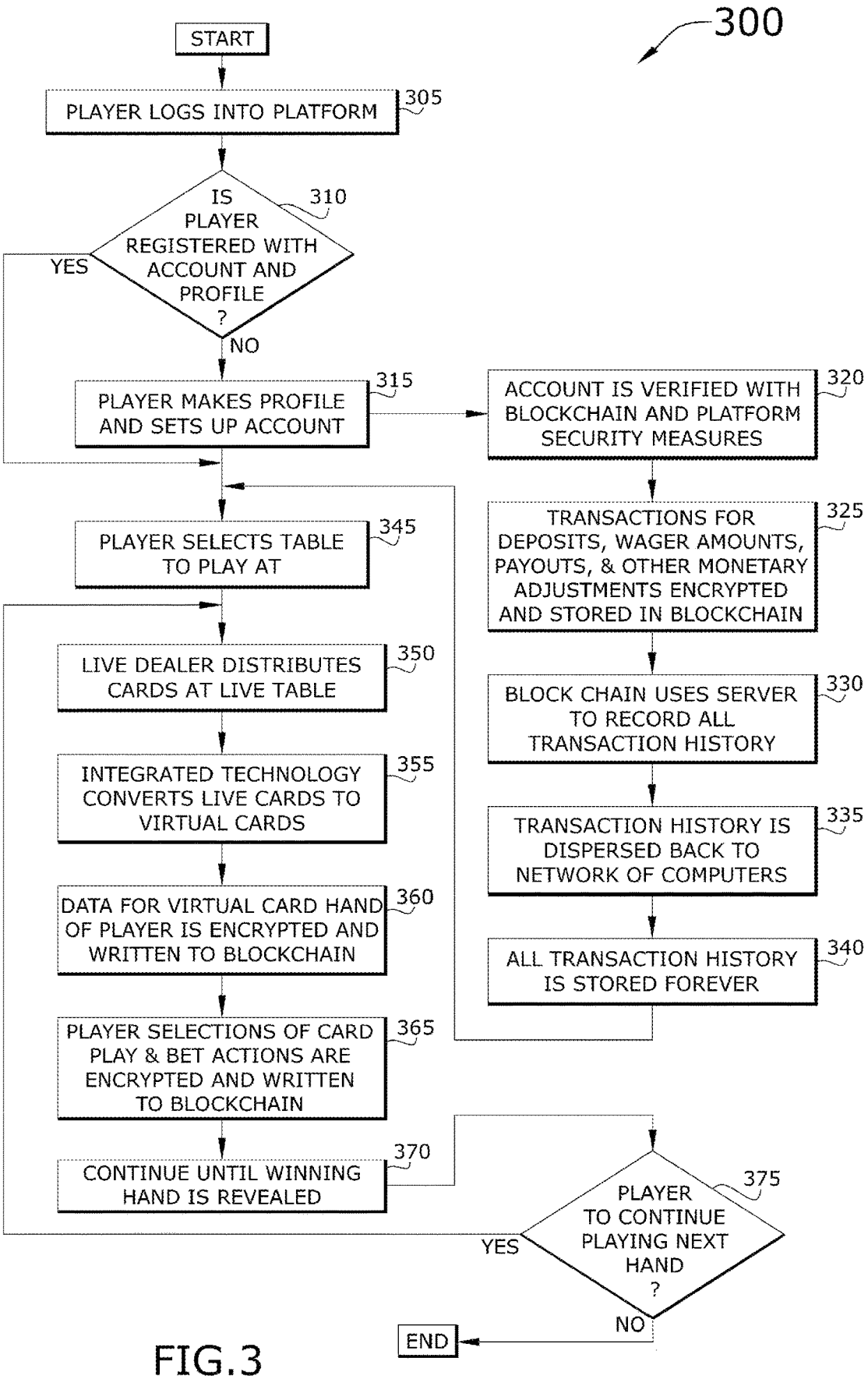

FIG. 3 conceptually illustrates a virtual poker process for securing virtual poker events by blockchain in some embodiments.

Figure 4:
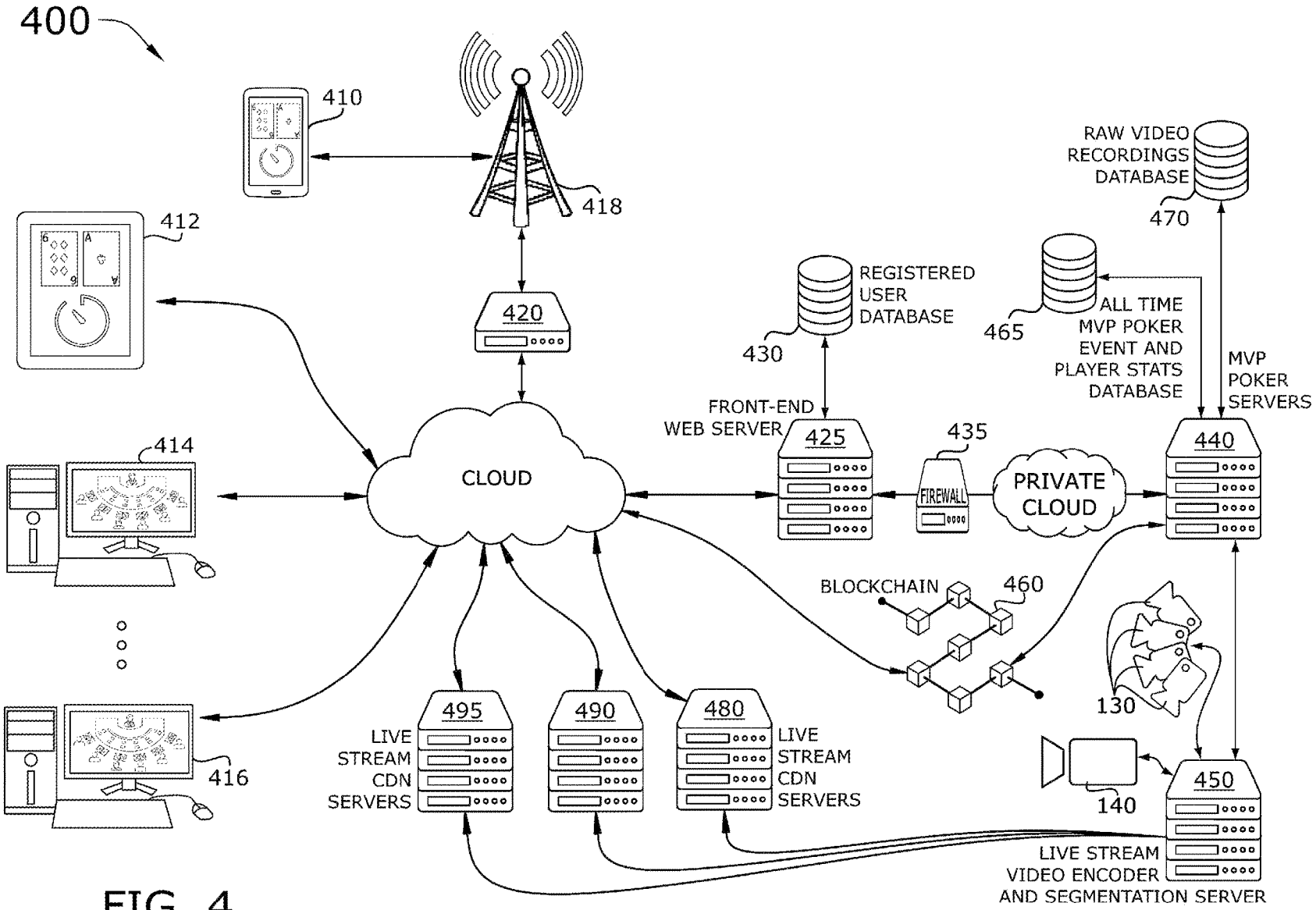

FIG. 4 conceptually illustrates a network architecture of a cloud-based secure and authentic online player and live dealer video streamed virtual poker system that hosts a cloud application service that provides a secure blockchain and live video stream-based virtual poker platform configured to promote integrity of play and authenticity of dealers and players in some embodiments.

Figure 5:
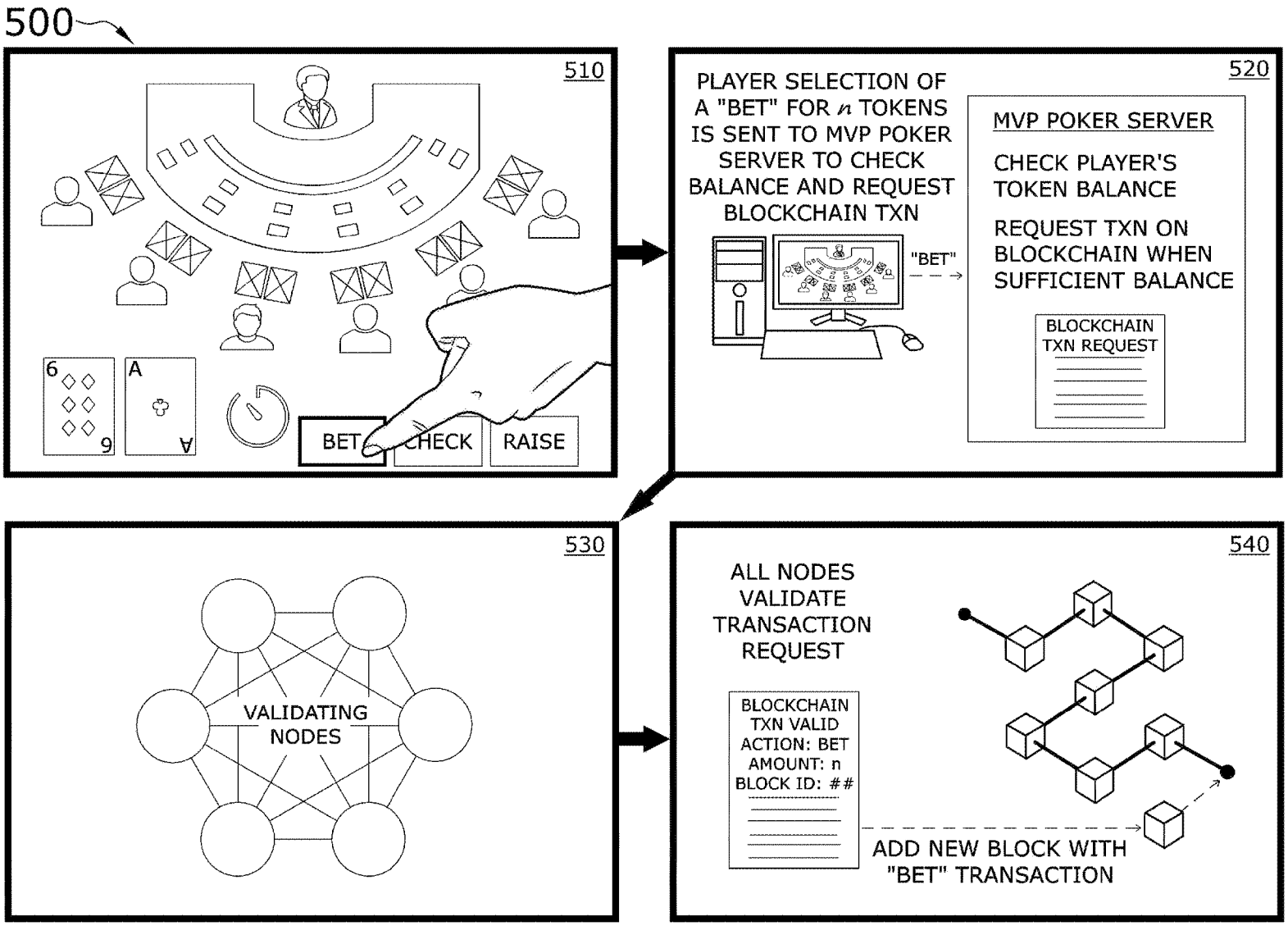

FIG. 5 conceptually illustrates a stage transition diagram that demonstrates an example of writing a player-initiated virtual "bet" action in a live streamed virtual poker event to a blockchain that secures all transactions of all players during the virtual poker event in some embodiments.

Figure 6:
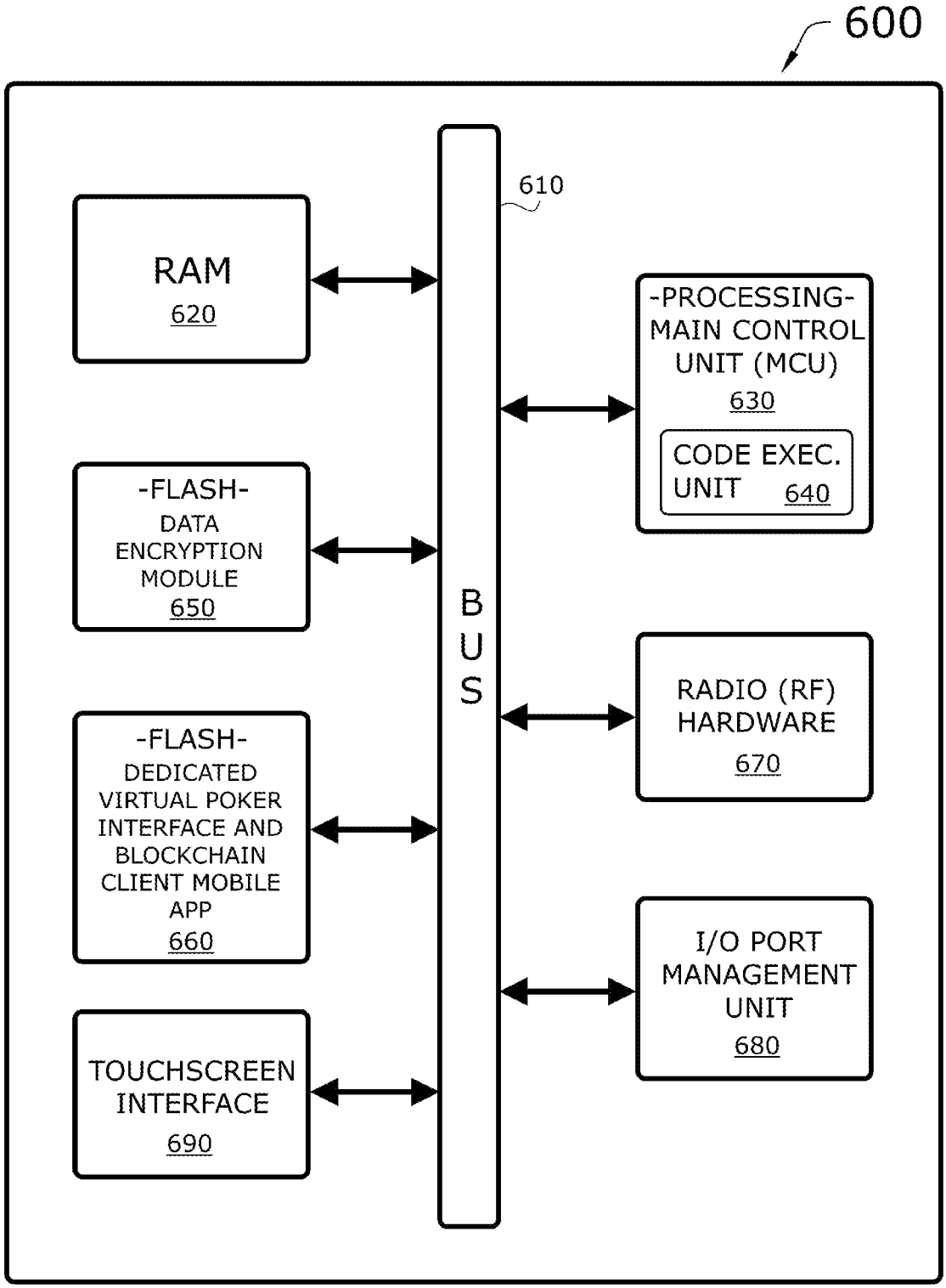

FIG. 6 conceptually illustrates a block diagram of a mobile device that is a validating node for blockchain transactions when running a dedicated virtual poker interface and blockchain client mobile app that is configured to allow a player to connect to the virtual poker platform and view live stream video of a poker event in which the player is a participant in some embodiments.

Figure 7:
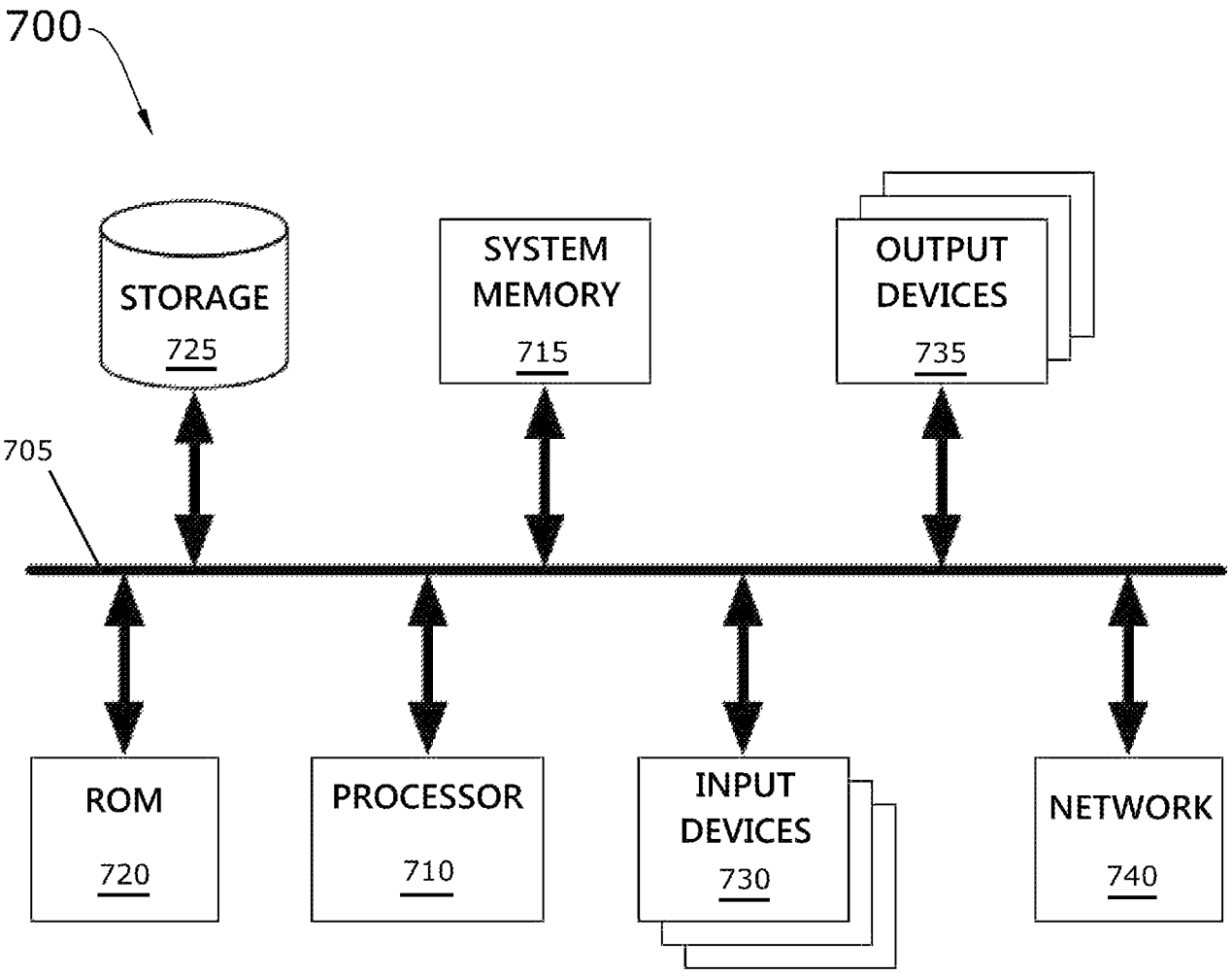

FIG. 7 conceptually illustrates an electronic system with which some embodiments of the invention are implemented.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the secure and authentic online player and live dealer video streamed virtual poker system provides a secure blockchain and live video stream-based virtual poker platform configured to promote integrity of play and authenticity of dealers and players. In some embodiments, the secure and authentic online player and live dealer video streamed virtual poker system connects real people online via a secure blockchain and live video stream-based virtual poker platform with a real, live action dealer to ensure integrity and increase security. In some embodiments, the secure and authentic online player and live dealer video streamed virtual poker system provides players the best live feel while being able to play poker remotely via online connection to the secure blockchain and live video stream-based virtual poker platform. In some embodiments, the secure and authentic online player and live dealer video streamed virtual poker system provides all users (poker players) the peace of mind of knowing that their cards are authentic and randomized. In some embodiments, the secure and authentic online player and live dealer video streamed virtual poker system provides a game flow that is a very similar representation to live poker, which provides a similar user experience to real life play. In some embodiments, the secure and authentic online player and live dealer video streamed virtual poker system allows for users to know, without a shadow of a doubt, that they are playing against other real people. In some embodiments, the secure and authentic online player and live dealer video streamed virtual poker system provides certainty of authenticity by live stream video of real, live dealers at real, live tables dealing real, live cards to virtual players, and by blockchain utilization, thereby eliminating concerns about bots and superusers.

In some embodiments, the secure and authentic online player and live dealer video streamed virtual poker system replaces algorithms and number generators found in typically online poker apps with a live human dealer at a live physical poker table and live hands dealt by the live human dealer, thereby lowering hand variance while effectuating true randomness of live dealt hands for online players. By using a live human dealer, no one can program into the application and win at egregious rates since superusers and bots are eliminated. In this way, the secure and authentic online player and live dealer video streamed virtual poker system allows poker players of all skill levels to play from the comfort of their home, while being dealt hands from an actual dealer.

Some embodiments of the secure and authentic online player and live dealer video streamed virtual poker process for promoting integrity of play in a virtual poker environment by way of blockchain and live streaming of a real live dealer at a real live poker table dealing real live cards to virtual players who are virtually positioned around the real live poker table comprises a plurality of steps. In some embodiments, the plurality of steps of the secure and authentic online player and live dealer video streamed virtual poker process comprises (i) a step for a player to log into the secure blockchain and live video stream-based virtual poker platform, (ii) a step for player registration as needed, (iii) a step for the player to select a table at which to play in a poker event, (iv) a step during which a live dealer distributes live cards at a live poker table, (v) a step for converting the live cards distributed to each virtual player to virtual cards of a virtual card hand dealt to each virtual player by way of integrated technology, (vi) a step for encrypting and writing data for the virtual cards in each virtual card hand to a blockchain, and (vii) a step during which virtual player interactions during the virtual poker event (including card play and bet actions selected by each virtual player) are encrypted and written to the blockchain. In some embodiments, steps (iv) through (vii) are repeated by the secure and authentic online player and live dealer video streamed virtual poker process for each virtual card hand played.

In some embodiments, the integrated technology comprises individual player cameras that are configured to capture video of the faces of cards distributed by the live dealer into card bays of a live table corresponding to the table selected by the player. In some embodiments, the integrated technology further comprises RFID tags that are disposed on the live cards and RFID readers at each card bay.

In some embodiments, the step for player registration comprises a step during which the player makes a profile and sets up an account. After the player makes the profile and sets up the account, the secure and authentic online player and live dealer video streamed virtual poker process of some embodiments verifies the account via the blockchain and other platform security measures configured to distinguish real live players from bots and superusers. After the account is verified, the secure and authentic online player and live dealer video streamed virtual poker process continues with further steps comprising (i) encrypting and storing transactions for deposits, wager amounts, payouts, and other monetary adjustments in the blockchain, (ii) recording all transaction history, by way of a server, in the blockchain, (iii) dispersing the transaction history to a network of computers associated with at least the virtual players, and (iv) persisting (storing forever) all transaction history in a poker event and player stats database.

As stated above, poker players simply do not trust online forums or applications and will only play live (in-person) poker. Historically, online poker companies have connected players via a simplistic virtual table with avatars representing each user. However, the existence of programmed computer players and prevalence of super users has resulted in lost trust among a substantially large portion of the poker playing community. As such, the online poker community has lost a large amount of credibility over the years due to corruption, collusion, and other nefarious actions. Embodiments of the secure and authentic online player and live dealer video streamed virtual poker system and process described in this specification solve such problems by reducing the likelihood of hacking/cheating due to the live nature of the playing card distribution. The secure and authentic online player and live dealer video streamed virtual poker system and process provides certainty of authenticity of players and dealers, such that playing with a live dealer and real players is known and verified before a player joins play from the comfort of their home (via remote access).

Embodiments of the secure and authentic online player and live dealer video streamed virtual poker system and process described in this specification differ from and improve upon currently existing options. In particular, some embodiments differ by providing unparalleled security (and integrity) to the online poker community. None of the conventional, existing online poker systems provide online poker games with a live dealer. Competitors use algorithms and number generators to virtually represent the "shuffling" of playing cards and distributing (dealing) of virtual playing cards. Players worldwide currently scrutinize the so-called "randomness" of the generators and the integrity of the sites themselves. Fears of "super users" with unsolicited access to other players' card information continues to increase. Moreover, fear of fake players (which are programmed to play specific hands) taking real players' money is another concern that is addressed by way of the secure and authentic online player and live dealer video streamed virtual poker system and process presented in this specification.

With conventional online systems, every time a real player joins an active game (to play) they cannot verify if they are playing against an actual person or a fake user (programmed computer player). This leads to issues with integrity and possible cheating. Also, the current virtual experience requires companies to use number generators to "randomize" cards. Yet, it is routinely argued that the number generators do not (in fact) offer the same randomness as live play. By contrast, the secure and authentic online player and live dealer video streamed virtual poker system and process of some embodiments slows down the flow of game play according to speed of the dealer, which reduces hand variance and provides players with a more accurate representation of live poker play, which engages the strategic thinking of players who would otherwise doubt their opponents authenticity.

The secure and authentic online player and live dealer video streamed virtual poker system and process of the present disclosure may be comprised of the following steps and elements. This list of possible constituent steps and elements is intended to be exemplary only and it is not intended that this list be used to limit the secure and authentic online player and live dealer video streamed virtual poker system and process of the present application to just these steps or elements. Persons having ordinary skill in the art relevant to the present disclosure may understand there to be equivalent steps or elements that may be substituted within the present disclosure without changing the essential function or operation of the secure and authentic online player and live dealer video streamed virtual poker system and process.

1. A player logs into the secure blockchain and live video stream-based virtual poker platform. In some embodiments, the secure blockchain and live video stream-based virtual poker platform is built and is deployed as a cloud-based software-as-a-service (SaaS) application (hereinafter also referred to as the "SaaS secure blockchain and live video stream-based virtual poker platform" or the "cloud application service"). The SaaS secure blockchain and live video stream-based virtual poker platform hosts a website to which the players connect (via player computing devices) to interact with the secure blockchain and live video stream-based virtual poker platform. The SaaS secure blockchain and live video stream-based virtual poker platform and website are built on and run HTML5 PhP software to convert data and programming to provide overlay of virtual cards and player face/selfie videos or player avatars into live streamed video of the real poker table and real dealer. In this way, the live streamed video supports custom images to procure a live 3D/VR poker table in which an authentic human dealer is distributing real cards (which are converted to virtual cards for player interface view) at a real table to player positions around the table (which are represented by overlayed player face/selfie videos and/or player avatars).

2. The player registers (if needed) as a user of the secure blockchain and live video stream-based virtual poker platform. During registration, the player makes a profile and sets up an account.

3. The player selects table at which to play a realtime poker event.

4. A live human dealer at a live poker table, associated with the table selected by the player, distributes real cards at the live poker table. The live dealer is essential part for the integrity of the game. This will allow the secure blockchain and live video stream-based virtual poker platform to not use algorithms or number generators for the flop and post flop actions. Moreover, this will mimic a live (conventional) poker experience due to the pace of play.

5. Integrated technology converts the live cards, as dealt by the live dealer, to virtual cards for (only) the player to view. Other players at the same table can view the virtual cards, as converted by the integrated technology, corresponding only to the real cards they were dealt by the live dealer. The integrated technology (e.g., video imaging, RFID, NFC, etc.) is needed to convert live poker hands into virtual hands for player access (online), which enables the user to make choices and virtually select actions (such as betting, raising, checking, etc., which are hereinafter referred to individually and collectively as "bet actions" or "betting actions") in order to play their poker hand. All such actions and interactions are recorded to blockchain. The software, which each player uses to access and interact with the secure blockchain and live video stream-based virtual poker platform, is configured to operate as a validating node for each blockchain (distributed ledger) being used for the player-selected table. Thus, blockchain transactions are automatically validated by comparison to the distributed ledger copies stored in memory space of the software running on the client device for each player. In this way, the poker events and other items (balances, tokens, chips, etc.) are immutable and, therefore, secure. Also, all such data is needed for the secure blockchain and live video stream-based virtual poker platform to declare a winner and reward players accordingly (e.g., with virtual chips, tokens, points, etc.).

6. Viewing of the virtual cards and live stream video of the live dealer at the live table is enabled by software, specifically, website and dedicated web app (running within a browser) and/or dedicated software application (e.g., desktop software application, mobile app, etc.).

7. Player interactions through the software in connection with the secure blockchain and live video stream-based virtual poker platform mimic live play of conventional poker game play. The player experience entails using the application or website, while the live stream video is streamed to players by the server or by content delivery network servers. In this way, players will be able to play online poker remotely from their computing device, while seeing other players, and the live dealer and poker or casino table.

The secure and authentic online player and live dealer video streamed virtual poker system and process of the present disclosure generally works by combining the following components to allow for/provide a realistic user experience (similar to live poker play), which eliminates concerns of fraudulent activity and provides for higher customer satisfaction. A live dealer (with real cards), integrated hardware/software technology (e.g., video imaging, RFID, NFC, etc.) to convert live poker hands into virtual poker hands, video distribution for live feed of video captured of the live dealer at the live poker table, a website and cloud-based software application service (with user interface), and user access/interaction. The live poker dealer will distribute real playing cards at a real (or live) poker table to create real poker hands. Those hands are converted to digital imagery for virtual poker hands via software and hardware commonly used for displaying poker hand information in realtime on a client computing device screen. In some embodiments, the digital imagery for the virtual poker hands are embedded into the live stream video or overlaid on the live stream video that is streamed in realtime to each player's client computing device screen. Notably, the digital imagery for the virtual poker hands is displayed on the screen of the client computing device whether the player is running dedicated software or a browser that is accessing the website online to allow for user access. For added security/protection, some games (hosted by and accessible through the secure blockchain and live video stream-based virtual poker platform) will require that the user to display their face (via webcam) in order to participate. Users will then interact with the virtual hands (via the user interface software—either dedicated software application/app or website with web app) in order to generate virtual poker chips (or tokens, points, etc.), and try to win. All transactions based on such player interactions are also written to blockchain, which is validated by the software instance (again, either dedicated application or website/web app) associated with each player in a game/present at a table. The blockchain transaction validation is carried out automatically as an underlying process of the software by way of application programming (C # C++ HTML5 and PhP). Thus, the players engage in play as normal without having to do anything to participate in as an active node in the blockchain.

In some embodiments, the software application functions to enable user authentication when signing into the website or cloud service. In some embodiments, the user authentication requires the player to input a username and a password to access the secure blockchain and live video stream-based virtual poker platform. In some embodiments, the user authentication is two-factor authentication, such as username/password plus another verifiable item, such as a code sent to a cell phone of the player. The player must provide accurate identification when registering to create a username and a password. Furthermore, the software application functions by loading stakes (such as funds via cryptocurrency other secure funding options, virtualized funds, etc.), customizing a player avatar (if deciding not to use webcam for live streaming the player's own selfie/face video), (optionally) purchasing virtual coins, tokens, points, chips, or other, to extend time during game play, etc. The application will provide multiple options of game types (e.g., Omaha, Texas Hold'em, Short Deck Poker, and other table games). Then the client can choose the stakes they want to play (if any) or request a customized table with stakes and rules. Once selected, a player will be sent to a table, where they will connect to a live table and real human dealer. This will be seen through a live feed (or live stream video) captured by video hardware at the site of the live dealer and live table, and after transmission to each player computing device, is visually output as a live stream within the software application (either dedicated software or website). Also, all players will have the option live feed their own face while playing which is visually output in connection with the live stream video.

Specifically, a live video is captured (by a main table video camera) at the real poker table and delivered ("transmitted" or "streamed") via the server and/or content distribution network servers to the online website/application for viewing by the user. If a player is live streaming their own selfie/fact while playing, then the live stream selfie/face of the player is visually output as an overlay to the main live stream video and proximate to a position at the table associated with their player seat. Alternatively, when not live streaming their selfie/face, an avatar of the player can be overlayed or meshed with the live stream video of the live table/live dealer. Whether the video representation of a player is a live stream selfie/face of the player or avatar of the player, the player video representation is positioned at a particular location around the table, such that each player is assigned a different position around the table to enable all live stream selfie/face videos and/or avatars to be visible as an overlay on the main poker table/dealer video stream. Along with the live stream video and overlay player selfie/face videos/avatars, the interface of each client-side software includes several interactive tools which enable players to interact with the game to make bets, raises, check, and so forth. Another tool is a timer that is configured to constrain each player to make a move (via selection of one of the interactive tools) within a specific time duration when it is their turn. In this way, players proceed to play in the poker or card event, based on the known and established rules of the particular game selected by the players, with the live dealer dealing real card hands in according with those rules.

Notably, the cards are real live cards which are physically dealt by the live dealer at the live table and all players can see a view of the live card dealing in realtime by the live stream video captured by the main table video camera. Each particular player is also entitled to view digital, virtual face cards of the particular hand in which the particular player is dealt. In some embodiments, this is accomplished by individual player cameras. In some embodiments, the real poker table is equipped with a plurality of individual player cameras that are positioned at locations around the table at which players are designated to be present (virtually present in this case, but in conventional poker, actually present). Each individual camera is oriented with a field of view to capture the faces of the cards as dealt. Thus, the individual cameras in some embodiments are positioned under the surface of the table and the table itself includes a transparent surface for the card bay in which the cards are dealt. In some other embodiments, the physical cards are equipped with unique RFIDs which correspond to the suit and rank of each card. In this case, the physical, live poker table is equipped with RFID readers at each card bay or player location around the table. The RFID reader can then "read" the RFID tag on each card dealt for a player and convert this information into virtual cards to display in the user interface of the online website/application for the player corresponding to the cards.

In some embodiments, when a player decides to leave the game/table, their account will be credited with the amount of virtual chips (or "tokens") they left the game with. The accounting of virtual chips for any given player is indisputable because the system utilizes a distributed ledger (blockchain) for each table or poker event, with all players acting as validating nodes for any and all bets, raises, pot totals, winnings, loses, etc., such that playing through the app automatically validates virtual chip/token balances by comparison to the distributed ledgers used by the app for each player. Also, the virtual chips/tokens can be converted into cryptocurrency upon withdrawal.

The virtual poker platform of the present disclosure creates an atmosphere for live poker dealers to deal real playing cards at real poker tables that is live streamed to players for interaction and game play by the players in virtualized interfaces (e.g., online). This is done by employing or installing technology (e.g., video imaging, RFID tagged cards and RFID readers, etc.) in order to read poker hands and convert them into virtual hands to be displayed via website/software application. This is made available by a hosted software application service (SaaS) that provides a unique poker platform (website and software application) for players to choose specific poker games, view the live dealers, interact with the dealt cards/hands, and even display live feed of themselves to interact as if they were at a live poker game, and to offer user customizations and enable quick deposit/withdrawal via website/app, with verifiable accounting of all transactions recorded to blockchain (distributed ledger), to improve on the traditional online poker experience.

To make the secure and authentic online player and live dealer video streamed virtual poker system and process of the present disclosure, a person may implement software (such as a dedicated software application or a website/web app) that is programmed via program languages such as C #, C++, HTML5, PhP, etc., and which integrates technology such as video cameras, live streaming, video imaging, RFID, NFC, etc. The person may also use other coding languages, such as Python, along with RTC camera technology connecting them through a dedicated server linking the virtual account to the live feed of the live dealer. While using NFC or RFID coded playing cards to convert the live dealt hand to what the player sees on their virtual screen, individual player cameras may also be deployed to capture images of the card hands as dealt by the live dealer, and subsequently converted to digital images of a virtual card hand. Also, the live stream video may be distributed in realtime to one or more content delivery network servers which are located in different places to effectuate faster retrieval by client computing devices of the live stream video. Deployment and utilization of a content delivery network with multiple content delivery network servers is advantageous when such servers are positioned throughout a wide geographic area (e.g., around the globe), thereby providing client computing devices in each region or area with a faster content retrieval mechanism that obviates the need for redundant, longer round-trip requests for each segment of video after capture, encoding and segmentation by a live stream video encoder and segmentation server of the secure blockchain and live video stream-based virtual poker platform.

To use the secure and authentic online player and live dealer video streamed virtual poker system and process of the present disclosure, a user (also referred to as a "client", a "player", a "registered user", or a "member") connects to the secure blockchain and live video stream-based virtual poker platform by way of a computing device (e.g., a laptop or a desktop computer, a mobile device or a smartphone, a tablet computing device, etc.). After connecting, the user completes login authentication, and participates in one or more online poker events or games, at one or more tables.

By way of example, FIG. 1 conceptually illustrates a schematic diagram of a virtual poker system that promotes integrity of play and authenticity of dealers and players 100. Several elements of the virtual poker system that promotes integrity of play and authenticity of dealers and players 100 are shown in this figure including a live dealer 110, a live table 120, a plurality of individual player cameras 130, a main table video camera 140, a player computing device 150, and a player 160. The elements are configured in a way such when the live dealer 110 distributes live cards to card bays of the live table 120 at various positions of players around the live table 120, the individual player cameras 130 capture the card hands for the respective player. The card hands are converted into digital card hands and provided to the player computing device 150 viewed by the player 160. Also, the main table video camera 140 captures a video of the entire live table 120 and live dealer 110 during the game. The captured video is live streamed to the player computing device 150 for viewing by the player 160 during the game. Also, the player 150 shown in this figure is only one player. However, there are typically multiple players who participate in the game at the live table 120 at any given time. Thus, the player computing device 150 corresponds to only the player 160, while other players in the game at the live table 120 would be using their own computing device to connect to and interact with the game by view of the live table 120 and live dealer 110 in the live stream video. Those other players would also view only the digital card hand converted from images/video of the live cards distributed to their respective card bay or live table 120 location, based on the individual player camera 130 proximate to the respective card bay or live table 120 location.

Turning to another example, FIG. 2 conceptually illustrates a user interface (UI) of a dedicated virtual poker interface and blockchain client software application 200 that is used to view a live stream video of a live poker dealer at a real poker table and interact with UI tools for a poker event. In some embodiments, the dedicated virtual poker interface and blockchain client software application 200 comprises a dedicated virtual poker interface and blockchain client mobile app running on a mobile device of a player. In some embodiments, the dedicated virtual poker interface and blockchain client software application 200 comprises a dedicated virtual poker interface and blockchain client web app running in a browser on a computing device, such as a desktop computer or a laptop computer of a player.

As shown in this figure, the UI of the dedicated virtual poker interface and blockchain client software application 200 includes an individual player view 205 associated with a particular individual player, a live stream video feed display 210 as captured by the main table camera 140 at the live table 120 with the live dealer 110 and streamed in realtime, several opponent players 215 positioned around the live table 120, a player representation 220 associated with the particular player which may be a selfie/face video of the particular player or an avatar representing the particular player, several card hands 225 dealt by the live dealer 110, a particular hand display 230 with cards as dealt as captured by the individual player camera 130 at a position of the live table 120 corresponding to the particular player and then converted to digital representations of the individual player cards 235, an account balance UI tool 240, a bet UI button 245, a check UI button 250, a raise UI button 255, and a countdown timer 260.

By way of example, FIG. 3 conceptually illustrates a secure and authentic online player and live dealer video streamed virtual poker process 300 for promoting integrity of play in a virtual poker environment by way of blockchain and live streaming of a real live dealer at a real live poker table dealing real live cards to virtual players who are virtually positioned around the real live poker table in some embodiments. As shown in this figure, the secure and authentic online player and live dealer video streamed virtual poker process 300 starts with a player signing into the secure blockchain and live video stream-based virtual poker platform (at 305). Signing into the secure blockchain and live video stream-based virtual poker platform is a user authentication step that may require a single factor authentication (e.g., username/password) or two-factor authentication (e.g., username/password and a code input upon receiving a code, for example, sent to a phone of a player who is trying to access the secure blockchain and live video stream-based virtual poker platform).

Next, the secure and authentic online player and live dealer video streamed virtual poker process 300 determines (at 310) whether the player is registered with an account and a profile already established. When the player is already registered, the secure and authentic online player and live dealer video streamed virtual poker process 300 proceeds to a step at which the player selects a table at which to play (at 345), which is further described below. On the other hand, when the player is not determined (at 310) to already be registered, the secure and authentic online player and live dealer video streamed virtual poker process 300 moves ahead to a step at which the player makes a profile and sets up an account (at 315) on the secure blockchain and live video stream-based virtual poker platform. In some embodiments, registration requires that a player deposits a certain minimum amount of value, such as a minimum amount of cryptocurrency, a minimum amount of transferrable chips, tokens, or points, or a minimum monetary amount.

After the player makes a profile and sets up an account, the secure and authentic online player and live dealer video streamed virtual poker process 300 of some embodiments verifies the account (at 320). In some embodiments, the account is verified with blockchain and one or more security measures employed by the secure blockchain and live video stream-based virtual poker platform. An example of a blockchain associated with game play through the secure blockchain and live video stream-based virtual poker platform is described below, by reference to FIGS. 4 and 5.

Upon verification of the account for the player, the secure and authentic online player and live dealer video streamed virtual poker process 300 proceeds to a step for encrypting and storing transactions for deposits, wager amounts, payouts, and other monetary adjustments in the blockchain (at 325). Next, the secure and authentic online player and live dealer video streamed virtual poker process 300 moves on to a step for recording all transaction history, by way of a server, in the blockchain (at 330) by the server that hosts the secure blockchain and live video stream-based virtual poker platform. The next step performed by the secure and authentic online player and live dealer video streamed virtual poker process 300 includes dispersing the transaction history to a network of computing devices associated with at least all of the players at the live table in the game (at 335). Then, the secure and authentic online player and live dealer video streamed virtual poker process 300 continues to the next step for persisting (at 340) all transaction history in a poker event and player stats database. An example of a poker event and player stats database is described below, by reference to FIG. 4. In some embodiments, the persistence of data is intended to store the transaction history forever. After persisting the transaction history (at 340), the secure and authentic online player and live dealer video streamed virtual poker process 300 cycles back to the step at which the player selects the table at which to play (at 345).

In some embodiments, after the live table has been selected by the player, the secure and authentic online player and live dealer video streamed virtual poker process 300 continues to the next step at which the live deal at the live table distributes live cards to the players (virtually) at the table for the game (at 350). Integrated technology then converts the live cards as dealt by the live dealer to virtual cards (at 355). In some embodiments, the integrated technology comprises individual player cameras that are configured to capture video of the faces of cards distributed by the live dealer into card bays of a live table corresponding to the table selected by the player. In some embodiments, the integrated technology further comprises RFID tags that are disposed on the live cards and RFID readers at each card bay.

In some embodiments, the secure and authentic online player and live dealer video streamed virtual poker process 300 moves forward to the next step during which data for the virtual card hand of the player is encrypted and written to the blockchain (at 360). This way, an immutable record of the game is stored for each virtual hand (and subsequently, any player actions with respect to the virtual hands for the game). Thus, the secure and authentic online player and live dealer video streamed virtual poker process 300 of some embodiments proceeds to the next step at which player selections of card play and bet actions are encrypted and written to the blockchain (at 365). The secure and authentic online player and live dealer video streamed virtual poker process 300 continues until a winning hand is identified and revealed (at 370). After the winning hand is revealed, the secure and authentic online player and live dealer video streamed virtual poker process 300 of some embodiments determines (at 375) whether the player intends to continue playing for the next dealer hand. When the player continues, the secure and authentic online player and live dealer video streamed virtual poker process 300 transitions back to the step at which the live dealer distributes the cards for the next game at the live table (at 350) and continues in the manner described above. That is, the steps of the secure and authentic online player and live dealer video streamed virtual poker process 300 continue for as many hands as the player wishes to play, repeating the steps accordingly for each live hand converted to virtual card hand played. On the other hand, when the player is not determined (at 375) to continue playing the next hand, then the secure and authentic online player and live dealer video streamed virtual poker process 300 ends.

By way of example, FIG. 4 conceptually illustrates a network architecture of a cloud-based secure and authentic online player and live dealer video streamed virtual poker system 400 that hosts a cloud application service that provides a secure blockchain and live video stream-based virtual poker platform configured to promote integrity of play and authenticity of dealers and players in some embodiments.

As shown in this figure, the cloud-based secure and authentic online player and live dealer video streamed virtual poker system 400 includes a set of computing devices 410-416, a wireless communication point 418 (e.g., a cell tower for cellular data communication), a gateway 420, a front-end web server 425, a registered user database 430, a firewall 435, secure blockchain and live video stream-based virtual poker server(s) 440 (also referred to as "MVP poker server(s) 440"), a live stream video encoder and segmentation server 450, a blockchain 460, an all time MVP poker event and player stats database 465, a raw video recordings database 470, and a plurality of live stream content delivery network (CDN) servers 480, 490, and 495.

The set of computing devices 410-416 are operated by users, players, members, administrators, viewers, etc. The set of computing devices 410-416 (hereinafter referred to as the "member computing devices 410-416" operated by "MEMBER #1", "MEMBER #2", "MEMBER #3", and "MEMBER #4", respectively) connect over the Internet (the "cloud" as it is labeled in this figure) to the front-end web server 425 to login with authentication details compared to registered member profiles stored in the registered user database 430 or, when not already registered as a member, to register as a new member by making a user/member profile and setting up their account. Unlike the member computing devices 412-416, which connect to the front-end web server 425 directly over the Internet (or "cloud"), the member computing device 410 connects to the front-end web server 425 by way of a wireless connection to the wireless communication point 418 and through the gateway 420, finally connecting over the Internet (or "cloud") to the front-end web server 425 and, upon successful login authentication to bypass the firewall 435, to the secure blockchain and live video stream-based virtual poker server(s) 440. While the example shown in this figure only illustrates member computing device 410 connecting via the wireless communication point 418 and through the gateway 420, it should be understood that any mobile device (e.g., member computing device 412, which is a tablet computing device) configured to connect wirelessly by cellular or other mobile device signal can also connect via the wireless communication point 418 and through the gateway 420 to ultimately access the secure blockchain and live video stream-based virtual poker platform running as as a software-based cloud application service on the secure blockchain and live video stream-based virtual poker server(s) 440.

The secure blockchain and live video stream-based virtual poker server(s) 440 provide backend processing and central video stream management for individual network streaming sessions through which different member users connect to different poker tables to engage as players in different poker events, such as games, tournaments, etc. When deployed as a software-as-a-service (SaaS), the secure blockchain and live video stream-based virtual poker server 440 runs a secure blockchain and live video stream-based virtual poker software platform as a cloud application service that provides a secure blockchain and live video stream-based virtual poker platform configured to promote integrity of play and authenticity of dealers and players.

In some embodiments, the cloud-based secure and authentic online player and live dealer video streamed virtual poker system 400 records all poker events at live poker tables with live dealers via the main table camera 140 and individual player cameras 130. In some embodiments, the raw video captured by the main table camera 140 is output to the live stream video encoder and segmentation server 450. In some embodiments, the live stream video encoder and segmentation server 450 transmits the raw video to the secure blockchain and live video stream-based virtual poker server 440 to persistently store in the raw video recordings database 470. In some embodiments, the live stream video encoder and segmentation server 450 also converts images captured by the individual player cameras 130 of the cards as dealt by the live dealer. The converted images of the cards are intended for display in a view screen for the player, such as the individual player view 205 described above, by reference to FIG. 2. The conversion involves digitizing the live dealt cards so that clear digital images of the cards are visually output in the player view during a poker game, such as the digitized individual player cards 235 shown in the individual player view 205 described above, by reference to FIG. 2. After conversion, the digital converted player cards for each individual player are retrieved from the live stream video encoder and segmentation server 450 by the secure blockchain and live video stream-based virtual poker server 440. Furthermore, in some embodiments, the real live cards include RFID tags so that the real live cards, after distribution by the live dealer at the live poker table, can be automatically read by an RFID reader/scanner that is positioned near each card bay or player position around the live poker table. The RFID read/scanner then identifies and outputs the individual player player cards to the secure blockchain and live video stream-based virtual poker server 440, which retrieves digital card images corresponding to the RFID tag identity of each card. In short, whether the live cards are captured by the individual player cameras 130, read or scanned by RFID readers that identify the cards by the RFID tags on the cards, or both, the resulting cards for each individual player are represented as digital card images. With such digital card images, the secure blockchain and live video stream-based virtual poker server 440 of some embodiments encrypts the digital card images for each player and transmits the encrypted cards to the corresponding member computing device operated by the individual player. In some embodiments, the dedicated virtual poker interface and blockchain client software application utilizes a data encryption module to decrypt (or decode) the encrypted digital card images. In some embodiments, the dedicated virtual poker interface and blockchain client software application employs a password associated with the profile of the member to encrypt and decrypt the digital cards. Thus, if the wrong digital encrypted cards are incorrectly transmitted to the wrong member, the dedicated virtual poker interface and blockchain client software application for the member will not be able to decrypt and view the individual player cards since the other member's profile information is used for encryption and decryption. In this way, the dedicated virtual poker interface and blockchain client software application allows players to connect to the virtual poker platform and view live stream video of a poker event in which the player is a participant and view the digital card images of the live cards which they are dealt by the live dealer as seen in the live stream video of the live poker table, even though the live stream video would show the dealt cards face down.

In some embodiments, the live stream video encoder and segmentation server 450 also encodes the raw video into a digital playback format suitable for live streaming and segments the encoded video for transmission as a live stream directly to any or all of the member computing devices 410-416. In some embodiments, the cloud-based secure and authentic online player and live dealer video streamed virtual poker system 400 accesses a content delivery network (CDN) to improve overall transmission times for delivery to the member computing devices 410-416 of the live stream videos of live dealers captured at each live poker table. As such, the live stream video encoder and segmentation server 450 also encodes and segments the raw video into the digital playback format for transmission to the live stream CDN servers 480, 490, and 495, through which the member computing devices 410-416 may access the live stream videos.

As noted above, the cloud-based secure and authentic online player and live dealer video streamed virtual poker system 400 accesses a content delivery network (CDN) to improve overall transmission times for delivery to the member computing devices 410-416 of the live stream videos of live dealers captured by the main table video camera at each live poker table. In this figure, the plurality of live stream CDN servers 480, 490, and 495 are representative of live stream CDN servers at different physical locations. For example, the live stream CDN server 480 may be physically located in the United States and the live stream CDN server 490 may be physically located in a country in Europe, while the live stream CDN server 495 may be physically located somewhere else, say, in a country in South America. When the live stream CDN servers 480, 490, and 495 are deployed at physically distinct and wide-ranging locations, the ability to deliver live stream video in near realtime to the member computing devices 410-416 is greatly enhanced since the member computing devices 410-416 may be connecting to the secure blockchain and live video stream-based virtual poker server(s) 440 from virtually anywhere, but receiving the live stream video from a much closer location at a nearby live stream CDN server, with reduced round-trip time for request and video packet reception. Even member computing device 410, which is a mobile smartphone device, is able to receive live stream video content from the live stream CDN servers by way of the indirect connection to the cloud through the wireless communication point 418 and the corresponding gateway 420.

In some embodiments, the blockchain 460 immutably stores all transactions associated with game play, cards dealt, players, bets, amounts, etc. In some embodiments, the secure blockchain and live video stream-based virtual poker server 440 creates blocks to add to the blockchain 460 for each transaction and the member computing devices 410-416 automatically and seamlessly perform transaction validation to add the block to the blockchain 460. In some embodiments, the dedicated virtual poker interface and blockchain client software application includes a node validation service that runs in the background and listens for any newly added blocks whose transactions need validation. When the node validation service of the dedicated virtual poker interface and blockchain client software application detects a new transaction/block being written to the blockchain 460, the dedicated virtual poker interface and blockchain client software application compares each block of its own locally stored blockchain 460 with the version of the blockchain 460 provided by the secure blockchain and live video stream-based virtual poker server 440 in connection with the current transaction/block intended to be added to the blockchain 460. When the comparison is satisfactory, then the dedicated virtual poker interface and blockchain client software application sends a notification of validation for the new block/transaction and updates its own locally stored copy of the blockchain 460 to reflect the new block/transaction. Similarly, the dedicated virtual poker interface and blockchain client software application running on each of the member computing devices 410-416 associated with players who are participating in a poker game at a particular live table provides the same validation of the new block/transaction. When all member computing devices 410-416 of participating players provides validation notification, the secure blockchain and live video stream-based virtual poker server 440 updates the blockchain 460 accordingly. An example of node validation for blockchain transaction writing is described below, by reference to FIG. 5.

In some embodiments, the secure blockchain and live video stream-based virtual poker server 440 calculates, tabulates, and manages all time poker game and player statistics. In some embodiments, the secure blockchain and live video stream-based virtual poker server 440 stores the data as calculated, tabulated, or otherwise aggregated in the all time MVP poker event and player stats database 465. In this way, individual players can track their own data over time (not just for a single game) and view high ranking players or others when/if tournament play occurs or a ranking system is deployed.

To use the cloud-based secure and authentic online player and live dealer video streamed virtual poker system 400, a user of a member computing device 410-416 would first register a new member account (if the user is new) or login to the platform with proper credentials (e.g., username/password). If registering as a new member, the user would set up an account and complete a profile that includes information about the player. In some embodiments, the user may deposit funds in a cryptocurrency or a fiat currency. The new member's profile information would be stored in the registered user database 430 with a public viewable portion and a private portion. The public viewable portion of the member profile would then be used when the new member starts interacting with the dedicated virtual poker interface and blockchain client software application, which can be a web app implementation or a mobile app implementation. In this way, the new member is able to select from any of several live poker tables to join a poker game and otherwise play in poker events.

While each live dealer 110 at each live poker table 120 is located at a single, physical location, all new and existing (previously registered) member users connect to the cloud-based secure and authentic online player and live dealer video streamed virtual poker system 400 over a network (such as the Internet). Therefore, the member computing devices 410-416 can connect from virtually any location. In this figure, for example, MEMBER #1 is associated with member computing device 410, specifically a mobile device connected to the front-end web server 425 via the wireless access point 418 and the gateway 420. The member computing device 410 may be located in Europe, and based on the profile information about the member and region detection via IP address, the secure blockchain and live video stream-based virtual poker server 440 can specifically designate a particular live stream CDN server 480, 490, or 495 for the live stream video transmission to the member computing device 410 (at least for the current session). Of course, MEMBER #1 may be a routine traveler whose location changes frequently. Upon connection from another location, say, somewhere in a Southern European country, the member computing device 410 would start a session that is identified from a different geolocation (Southern Europe) and this new session could be directed by the secure blockchain and live video stream-based virtual poker server 440 to receive the live stream video from a different live stream CDN server that is closer to the present location of the member computing device 410.

By contrast, MEMBER #2 (the tablet member computing device 412) may be associated with a member user who connects to the front-end web server 425 and, consequently, the secure blockchain and live video stream-based virtual poker server 440 directly through the Internet (the "cloud"). While MEMBER #2 may move between several locations (due to the ease and mobility of a tablet device), if MEMBER #2 only moves physically within a small area (say, only within a particular city or region), then the live stream CDN server from which the member computing device 412 receives the live stream video is likely going to be the same every session. Similarly, MEMBER #3 (desktop member computing device 414) and MEMBER #4 (desktop member computing device 416) are unlikely to be too frequently mobile and would likely connect and receive the live stream videos of their sessions from the same live stream CDN server. However, were MEMBER #3 or MEMBER #4 to physically move (i.e., relocate their place of residence) to a geographically distinct area, then the secure blockchain and live video stream-based virtual poker server 440 could identify which live stream CDN server is closest to the detected (new) location and proceed accordingly.

By way of another example, FIG. 5 conceptually illustrates a stage transition diagram 500 that demonstrates an example of writing a player-initiated virtual "bet" action in a live streamed virtual poker event to a blockchain that secures all transactions of all players during the virtual poker event in some embodiments. As shown in this figure, the stage transition diagram 500 includes four stages 510-540. Specifically, at a first stage 510, a user (or player) interacts with the user interface of a dedicated virtual poker interface and blockchain client software application that is configured to allow the player to connect to the virtual poker platform and view live stream video of a poker event with a live dealer dealing physical playing cards at a live table. As the player in this case is a participant, the player is able to interact with the user interface to select the bet button to make a bet based on their hand as dealt by the live dealer.

Upon selecting the bet button in the first stage 510, the player inputs a value for the bet. For example, the user may specify a number 'n' of tokens (or chips, or a monetary value, etc.). The selection of the bet button and the input of n tokens triggers the dedicated virtual poker interface and blockchain client software application running on the member computing device of the player to transmit the bet action and amount (n tokens in this example) to the secure blockchain and live video stream-based virtual poker server, as shown at stage two 520 of the stage transition diagram 500. In some embodiments, the secure blockchain and live video stream-based virtual poker server checks a balance for the player (how many tokens or chips or money remains available to the player to bet in a game). When the balance is sufficient to cover the bet amount (e.g., n tokens), then the secure blockchain and live video stream-based virtual poker server makes a request to write a transaction for the player's bet to the blockchain.

At a third stage 530, several validating nodes process the transaction as requested in comparison of all blocks in the blockchain. When the validating nodes reach a consensus that the blockchain is accurate and complete, then the transaction can be written to the blockchain as a new block. In some embodiments, the new block is written with an action (e.g., 'bet', 'call', 'raise', etc.), an amount, and block ID, along with a link to the previous block in the blockchain, and summarily encrypted by chaincode operation in adding the new block. This is shown at stage four 540. Although not explicitly shown in the stage transition diagram 500, each of the validating nodes would add the new block to their local copies of the blockchain. In this way, any and all poker events, games, statistics, amounts, actions, and other related information is immutably stored in one or more blockchains. This enhances integrity of the secure and authentic online player and live dealer video streamed virtual poker system since audits of any and all transactions for any game, series of games, tournaments, etc., can be carried out with utter assurance of validity of all blocks/transactions.

Now, turning to another example, FIG. 6 conceptually illustrates a block diagram of a mobile device type of member computing device which acts a validating node for blockchain transactions when running a dedicated virtual poker interface and blockchain client mobile app that is configured to allow a player operating the mobile device 600 to connect to the virtual poker platform and view live stream video of a poker event in which the player is a participant. As shown in this figure, the mobile device 600 includes a bus 610, a random access memory (RAM) 620, a main control unit (MCU) 630 for runtime processing of the dedicated virtual poker interface and blockchain client mobile app used by a player to connect to and interact with the secure blockchain and live video stream-based virtual poker platform, a code execution unit 640 embedded within the MCU 630, a first persistent flash memory 650 that stores a data encryption module for data encryption and decryption, a second persistent flash memory 660 that stores the dedicated virtual poker interface and blockchain client mobile app used by the player to connect to and interact with the secure blockchain and live video stream-based virtual poker platform. The mobile device 600 also includes a radio (RF) hardware 670 unit for wireless data communication, an input/output (I/O) management unit 680 for data input/ output routing, and a touchscreen interface 690 for visual output of the user interface and individual player view as well as live stream video feeds of the live dealers at live poker tables, as well as to visually output other data, such as individual digital player cards after conversion and UI tools/buttons, the countdown timer, electronic documentation, instructions, deposit and balance information, account information, profile data, and other graphics.

The dedicated virtual poker interface and blockchain client mobile app used by the player, the various user interfaces, UI tools/buttons, views, and live stream videos, as well as embedded encryption code of the data encryption module stored in the first persistent flash memory 650 and all other relevant data are loaded into the RAM 620 and executed by the code execution unit 640 of the MCU 630 to provide the player access to live dealers at live poker tables in which live views are streamed as live stream video and in which the player may play in poker events remotely (in a virtual, network connected, manner) through the dedicated virtual poker interface and blockchain client mobile app. In particular, the data encryption module is loaded into the RAM 620 from the first persistent flash memory 650 automatically when the dedicated virtual poker interface and blockchain client mobile app is launched on the mobile device 600 by the player, such that all data retrieved, transmitted, and stored by way of interactions with the dedicated virtual poker interface and blockchain client mobile app are automatically encrypted prior to internal storage on the mobile device 600 and prior to any network transfer of data via wired or wireless networks to the secure blockchain and live video stream-based virtual poker platform for storage in the blockchain 460, the all time MVP poker event and player stats database 465, and/or the registered user database 430 in connection with the back-end secure blockchain and live video stream-based virtual poker server(s) 440 or the live stream video encoder and segmentation server 450 deployed as backend custom processing hardware systems of the cloud-based secure and authentic online player and live dealer video streamed virtual poker system 400. The code execution unit 640 also encrypts login data input by the player to access and interact with the secure and authentic online player and live dealer video streamed virtual poker cloud application service via the dedicated virtual poker interface and blockchain client mobile app when running on the mobile device 600. In this way, player credentials for login authentication are encrypted when transmitted from the mobile device 600 to the secure and authentic online player and live dealer video streamed virtual poker cloud application service hosted by the secure blockchain and live video stream-based virtual poker server 440.

Many of the above-described features and applications are implemented as software processes that are specified as a set of instructions recorded on a computer readable storage medium (also referred to as computer readable medium or machine readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs, when installed to operate on one or more electronic systems, define one or more specific machine implementations that execute and perform the operations of the software programs.

FIG. 7 conceptually illustrates an electronic system 700 with which some embodiments of the invention are implemented. The electronic system 700 may be a computer, phone, PDA, or any other sort of electronic device. Such an electronic system includes various types of computer readable media and interfaces for various other types of computer readable media. Electronic system 700 includes a bus 705, processing unit(s) 710, a system memory 715, a read-only memory 720, a permanent storage device 725, input devices 730, output devices 735, and a network 740.

The bus 705 collectively represents all system, peripheral, and chipset buses that communicatively connect the numerous internal devices of the electronic system 700. For instance, the bus 705 communicatively connects the processing unit(s) 710 with the read-only memory 720, the system memory 715, and the permanent storage device 725.

From these various memory units, the processing unit(s) 710 retrieves instructions to execute and data to process in order to execute the processes of the invention. The processing unit(s) may be a single processor or a multi-core processor in different embodiments.

The read-only-memory (ROM) 720 stores static data and instructions that are needed by the processing unit(s) 710 and other modules of the electronic system. The permanent storage device 725, on the other hand, is a read-and-write memory device. This device is a non-volatile memory unit that stores instructions and data even when the electronic system 700 is off. Some embodiments of the invention use a mass-storage device (such as a magnetic or optical disk and its corresponding disk drive) as the permanent storage device 725.

Other embodiments use a removable storage device (such as a floppy disk or a flash drive) as the permanent storage device 725. Like the permanent storage device 725, the system memory 715 is a read-and-write memory device. However, unlike storage device 725, the system memory 715 is a volatile read-and-write memory, such as a random access memory. The system memory 715 stores some of the instructions and data that the processor needs at runtime. In some embodiments, the invention's processes are stored in the system memory 715, the permanent storage device 725, and/or the read-only memory 720. For example, the various memory units include instructions for processing appearance alterations of displayable characters in accordance with some embodiments. From these various memory units, the processing unit(s) 710 retrieves instructions to execute and data to process in order to execute the processes of some embodiments.

The bus 705 also connects to the input and output devices 730 and 735. The input devices enable the user to communicate information and select commands to the electronic system. The input devices 730 include alphanumeric keyboards and pointing devices (also called "cursor control devices"). The output devices 735 display images generated by the electronic system 700. The output devices 735 include printers and display devices, such as liquid crystal displays (LCD) and organic light emitting diode (OLED) displays. Some embodiments include devices such as a touchscreen that functions as both input and output devices—receiving input via human touch gestures and outputting visual data, graphics, images, and videos (as well as outputting audio with separate or integrated audio speakers).

Finally, as shown in FIG. 7, bus 705 also couples electronic system 700 to a network 740 through a network adapter (not shown). In this manner, the computer can be a part of a network of computers (such as a local area network ("LAN"), a wide area network ("WAN"), or an intranet), or a network of networks (such as the Internet). Any or all components of electronic system 700 may be used in conjunction with the invention.

These functions described above can be implemented in digital electronic circuitry, in computer software, firmware or hardware. The techniques can be implemented using one or more computer program products. Programmable processors and computers can be packaged or included in mobile devices. The processes may be performed by one or more programmable processors and by one or more set of programmable logic circuitry. General and special purpose computing and storage devices can be interconnected through communication networks.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the invention has been described with reference to numerous specific details, one of ordinary skill in the art will recognize that the invention can be embodied in other specific forms without departing from the spirit of the invention. For instance, FIG. 3 conceptually illustrates a process. The specific operations of this process may not be performed in the exact order shown and described. Specific operations may not be performed in one continuous series of operations, and different specific operations may be performed in different embodiments. Furthermore, the process could be implemented using several sub-processes, or as part of a larger macro process. Thus, one of ordinary skill in the art would understand that the invention is not to be limited by the foregoing illustrative details, but rather is to be defined by the appended claims.

We claim:

1. A cloud-based secure and authentic online poker system that provides a secure blockchain and live video stream-based virtual poker platform configured to promote integrity of play and authenticity of dealers and players, said cloud-based secure and authentic online poker system comprising:

a secure blockchain and live video stream-based virtual poker server that hosts a secure and authentic online player and live dealer video streamed virtual poker cloud application service to which computing devices of online players connect to remotely play poker card games at physical poker tables with human dealers;

a plurality of video cameras that each capture video of a live human dealer distributing live physical cards at a live table for a poker event with participating online players;

a live stream video encoder and segmentation server that is communicably connected to the plurality of video cameras, wherein each video camera is configured to output the captured video of the live human dealer distributing live physical cards at the live table to the live stream video encoder and segmentation server, wherein the captured video received from each video camera is encoded and segmented by the live stream video encoder and segmentation server before streaming the encoded and segmented video as a live video stream to the participating online players of the poker event at the live table;

a website provided by the secure and authentic online player and live dealer video streamed virtual poker cloud application service, wherein the website is configured to receive interaction by the participating online players during the poker event and to display a player view of the live stream video and individual digital player cards corresponding to each particular participating online player; and a blockchain that is configured to immutably store transactions associated with the poker event, wherein the computing devices of the participating online players act as validating nodes of the blockchain to validate any transaction requested by the secure blockchain and live video stream-based virtual poker server.

2. The cloud-based secure and authentic online poker system of claim 1 further comprising a plurality of individual player cameras that are configured to capture card faces of the live physical cards distributed by the live dealer to card bay positions around the live table.

3. The cloud-based secure and authentic online poker system of claim 2, wherein each card bay position around the live table corresponds to a visual indicator of a participating online player.

4. The cloud-based secure and authentic online poker system of claim 3, wherein the visual indicator of the participating online player comprises one of a video stream of a human person associated with the participating online player and a digital avatar representing the human person associated with the participating online player.

5. The cloud-based secure and authentic online poker system of claim 1 further comprising a plurality of RFID readers that are disposed around the live table proximate to card bay positions around the live table, wherein the RFID readers are configured to read RFID tags attached to the live physical cards that uniquely identify card suit and rank for each live physical card when distributed by the live dealer.

6. The cloud-based secure and authentic online poker system of claim 1 further comprising a front-end web server that is configured to display a first web page of the website for player login authentication and new member registration.

7. The cloud-based secure and authentic online poker system of claim 6 further comprising a registered user database that stores encrypted authentication data, account data, and profile data for each registered player.

8. The cloud-based secure and authentic online poker system of claim 1 further comprising a raw video recordings database the stores the raw video of live human dealers distributing live physical cards at live tables for poker events as captured by the plurality of video cameras.

9. The cloud-based secure and authentic online poker system of claim 1 further comprising an all time MVP poker event and player stats database that stores player statistics for poker events in which the player participated and enables all players to view totals of other players.

10. The cloud-based secure and authentic online poker system of claim 1, wherein the live stream video encoder and segmentation server is configured to transmit each encoded and segmented video to one or more content delivery network (CDN) servers for re-distribution as a live video stream to the participating online players of the poker event corresponding to the encoded and segmented video.

11. A secure and authentic online player and live dealer video streamed virtual poker process for promoting integrity of play in a virtual poker environment by way of blockchain and live streaming of a real live dealer at a real live poker table dealing real live cards to online players who are virtually positioned around the real live poker table, said secure and authentic online player and live dealer video streamed virtual poker process comprising:

distributing, by a live human dealer, live physical cards at a live table;

converting, by technology integrated with the live table, the distributed live physical cards to virtual cards;

encrypting the virtual cards for each card hand associated with a player;

adding transaction blocks with the encrypted virtual cards to the blockchain;

encrypting each player selection of play and bet actions; and adding transaction blocks with the player selections of play and bet actions to the blockchain until a winning hand is revealed.

12. The secure and authentic online player and live dealer video streamed virtual poker process of claim 11, wherein the technology integrated with the live table comprises a plurality of individual player cameras that are configured to capture card faces of the live physical cards after distribution by the live human dealer at the live table.

13. The secure and authentic online player and live dealer video streamed virtual poker process of claim 12, wherein the technology integrated with the live table further comprises a digital conversion module that converts the capture card faces to digital images of the cards showing rank and suit.

14. The secure and authentic online player and live dealer video streamed virtual poker process of claim 11, wherein the technology integrated with the live table comprises a plurality of RFID readers that are each configured to read unique RFID tags disposed on the live physical cards and identify the rank and suit of each live physical card to convert into a digital image of the physical card.

15. The secure and authentic online player and live dealer video streamed virtual poker process of claim 11 further comprising:

capturing, by a main table video camera, a video of the live human dealer distributing the live physical cards at the live table; and live streaming the captured video to a plurality of computing devices associated with a plurality of online players remotely participating in a poker game at the live table at which the live physical cards are distributed by the live human dealer.

* * * * *